US006213730B1

(12) United States Patent
Yasuda et al.

(10) Patent No.: US 6,213,730 B1
(45) Date of Patent: Apr. 10, 2001

(54) FLOW CONTROL APPARATUS FOR A HYDRAULIC PUMP

(75) Inventors: Masao Yasuda, Yokohama (JP); Konrad Eppli, Schwaebisch Gmuend (DE)

(73) Assignees: Unisia Jecs Corporation, Atsugi (JP); ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/103,531

(22) Filed: Jun. 24, 1998

(30) Foreign Application Priority Data

Jun. 24, 1997 (JP) ..... 9-166454

(51) Int. Cl.[7] ..... F04B 49/00
(52) U.S. Cl. ..... 417/307; 417/300; 417/310
(58) Field of Search ..... 417/307, 310, 417/440, 308, 300

(56) References Cited

U.S. PATENT DOCUMENTS

| | | | | |
|---|---|---|---|---|
| 4,047,846 | * | 9/1977 | Komamura et al. | 417/300 |
| 4,251,193 | * | 2/1981 | Minnis et al. | 417/300 |
| 4,422,834 | * | 12/1983 | Drutchas et al. | 417/310 X |
| 4,429,708 | * | 2/1984 | Strueh | 417/300 X |
| 4,470,768 | * | 9/1984 | Konz | 417/310 |
| 4,480,962 | * | 11/1984 | Niemiec | 417/307 X |
| 4,549,566 | * | 10/1985 | Fujiwara et al. | 417/300 X |
| 4,637,782 | * | 1/1987 | Teubler et al. | 417/300 |
| 4,681,517 | * | 7/1987 | Schulz et al. | 417/300 |
| 5,098,259 | * | 3/1992 | Ohtaki et al. | 417/308 |
| 5,112,199 | * | 5/1992 | Otaki et al. | 417/310 |
| 5,209,648 | * | 5/1993 | Ishizaki et al. | 417/310 |
| 5,226,802 | * | 7/1993 | Nakamura et al. | 417/310 X |
| 5,236,315 | * | 8/1993 | Hamao et al. | 417/300 X |
| 5,651,665 | * | 7/1997 | Can et al. | 417/300 |
| 5,669,761 | * | 9/1997 | Kobayashi | 417/308 X |
| 5,713,726 | * | 2/1998 | Nakayoshi | 417/310 |

FOREIGN PATENT DOCUMENTS

| | | | |
|---|---|---|---|
| 4433598 | * | 3/1996 | (DE) . |
| 44 33 598 | | 3/1996 | (DE) . |

* cited by examiner

*Primary Examiner*—Corrine McDermott
*Assistant Examiner*—Chen-Wen Jiang
(74) *Attorney, Agent, or Firm*—Foley & Lardner

(57) ABSTRACT

A variable flow control apparatus for a pump, including a discharge passage communicating with the pump, a variable flow control valve operative to vary a flow of fluid passing through the discharge passage and disposed within the discharge passage, and a flow control circuit cooperative with the discharge passage to permit a predetermined flow of the fluid. A drain valve within the flow control circuit is actuatable in response to a difference between pressures upstream and downstream of the variable flow control valve. The variable flow control valve includes a spool bore communicating with the discharge side of the pump, a spool moveably disposed in the spool bore and a spring unit biasing the spool to increase the opening area of the discharge passage. The spring unit includes first and second springs arranged in series.

20 Claims, 3 Drawing Sheets

FLOW CONTROL APPARATUS FOR A HYDRAULIC PUMP

BACKGROUND OF THE INVENTION

Field of the Invention

The present invention relates to a flow control apparatus for a positive-displacement pump such as rotary-vane pump, plunger pump, gear pump, and more particularly to the flow control apparatus for keeping a flow rate of fluid discharged from the pump at the high rotational speed which is lower than a flow rate of fluid discharged from the pump at the low rotational speed.

Generally, a positive-displacement pump, for instance, rotary-vane pump, installed in automotive vehicles which are driven by engines, is operated by the engine acting as power source and utilized as fluid pressure source for supplying hydraulic fluid to actuators of various hydraulic equipment, for instance, power steering systems.

Among various types of the power steering systems for assisting torque generated in manual steering by using hydraulic fluid, there is one type adapted to provide relatively great steering assistance at low vehicle speed and relatively small steering assistance at high vehicle speed. This is because the steering is stable at the high vehicle speed. A positive-displacement pump mounted to such type of the power steering system is required to discharge a high flow rate of fluid at the low rotational speed, i.e., at the low vehicle speed, and a low flow rate of fluid at the high rotational speed, i.e., at the high vehicle speed. For this reason, there have been recently proposed flow control apparatuses adapted to control a flow rate of fluid discharged from the pump and exhibit the aforementioned characteristic of the flow rate of fluid with respect to the rotational speed of the pump. Description of the Related Art One example of the flow control apparatuses as proposed is disclosed in German Patent Application First Publication No. DE4433598A1. The apparatus includes a variable flow control valve disposed within a discharge passage communicating with the discharge side of a positive-displacement pump, and a flow control circuit cooperating with the discharge passage to permit fluid to return the suction side of the pump. The flow control circuit includes a drain valve adapted to drain the fluid discharged from the pump in response to a difference between pressures upstream and downstream of the variable flow control valve. The variable flow control valve is operative to vary a flow of fluid that is discharged from the pump and delivered to actuators through the discharge passage. The variable flow control valve includes a spool facing the fluid discharged from the pump and moveable to vary an opening area of the discharge passage, and a spring biasing the spool so as to increase the opening area of the discharge passage. The drain valve and the variable flow control valve cooperate to control the flow rate of the discharged fluid passing through the discharge passage.

In this conventionally known apparatus, when the rotational speed of the pump increases beyond a set value up to a greater value than the set value, the drain valve and the variable flow control valve cooperate to reduce the flow rate of fluid passing through the discharge passage down to a predetermined value. Subsequently, when the rotational speed of the pump exceeds the greater set value, the drain valve and the variable flow control valve cooperate in order to keep the flow rate of fluid of the predetermined value. Under such condition as the rotational speed of the pump exceeding the greater set value, the flow rate of fluid discharged from the pump becomes much higher than the flow rate of fluid drained from the drain valve. However, the known apparatus tends to cause undesired increase in flow rate of fluid passing through the discharge passage over the predetermined value. When the pump is operated at the high rotational speed beyond the greater set value, the characteristic of the flow rate of fluid passing through the discharge passage becomes unstable due to the flow rate of fluid increasing as the rotational speed of the pump rises. This leads to decrease of operating accuracy of actuators and then hydraulic equipment to which the fluid discharged from the pump is supplied via the discharged passage.

It is an object of the present invention to provide a variable flow control apparatus for a positive-displacement pump that is capable of achieving a desirably stable characteristic of the flow rate of fluid discharged from the pump at the high rotational speed.

SUMMARY OF THE INVENTION

According to one aspect of the present invention, there is provided an apparatus for variably controlling a flow rate of fluid discharged from a positive-displacement pump, comprising:

a discharge passage communicating with the pump;

a variable flow control valve operative to vary a flow of fluid passing through the discharge passage, the variable flow control valve being disposed within the discharge passage; and a flow control circuit cooperative with the discharge passage to permit a predetermined flow of the fluid, the flow control circuit including a drain valve actuatable in response to a difference between pressures upstream and downstream of the variable flow control valve;

the variable flow control valve including a spool bore communicating with the discharge side of the pump, a spool moveably disposed in the spool bore and having positions where different opening areas of the discharge passage are defined, and a spring biasing the spool in such one direction as to increase the opening area of the discharge passage, the spool being displaceable between the positions by a biasing force of the spring and a force variably acting on the spool in response to the flow rate of fluid discharged from the pump;

wherein the spring includes a first spring and a second spring arranged in series.

According to further aspect of the present invention, there is provided an apparatus for variably controlling a flow rate of fluid discharged from a positive-displacement pump, comprising:

a discharge passage communicating with the pump;

a fixed orifice disposed within the discharge passage;

a flow control circuit cooperative with the discharge passage to permit a predetermined flow of the fluid, the flow control circuit including a drain valve actuatable in response to a difference between pressures upstream and downstream of the fixed orifice; and a variable flow control valve operative to vary a flow of fluid passing through the discharge passage, said variable flow control valve being disposed within the discharge passage downstream of the fixed orifice, the variable flow control valve including a spool bore communicating with the discharge side of the pump, a spool moveably disposed in the spool bore and having positions where different opening areas of the discharge passage are defined, and a spring biasing the spool in such one direction as to increase the opening area of the discharge passage, the spool being displaceable between the positions by a biasing force of the spring and a force variably acting on the spool in response to the flow rate of fluid discharged from the pump;

wherein the spring includes a first spring and a second spring arranged in series.

DESCRIPTION OF THE PREFERRED EMBODIMENT

Figure 1:
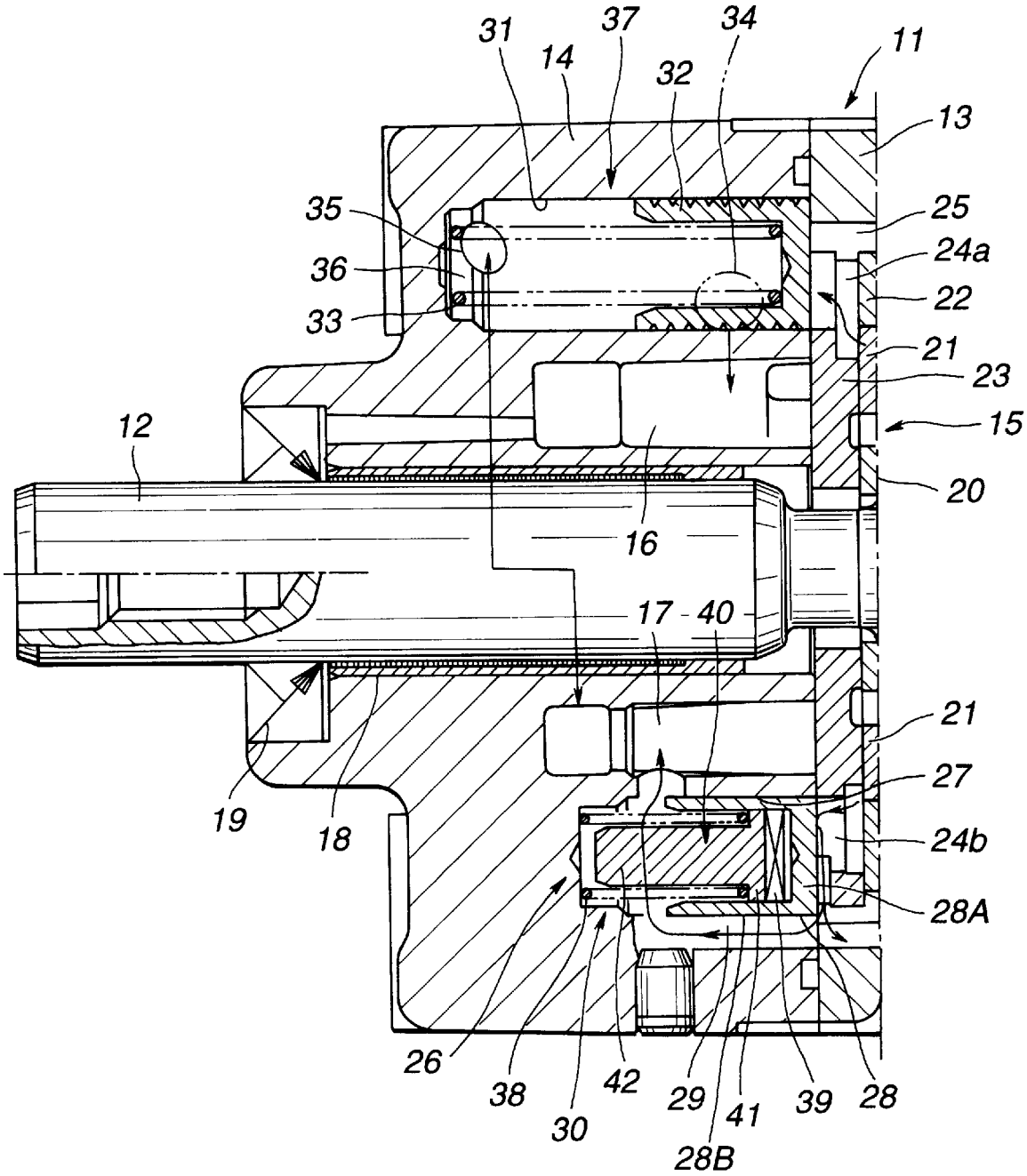
FIG. 1 is a longitudinal section, taken along an axis of a pump shaft, of a first embodiment of a flow control apparatus for a hydraulic pump, according to the present invention.

Referring now to FIG. 1, a first preferred embodiment of a flow control apparatus for a rotary-vane pump, according to the present invention is explained. The rotary-vane pump denoted at 11 in FIG. 1, is usable as a fluid pressure source for hydraulic actuators of various vehicle components such as power steering system, which supplies the actuators with two different flow rates of fluid in response to rotational speed of a power source of the vehicle. Namely, the rotary—vane pump 11 is driven by the power source having variable speed, for example, an engine, and adapted to supply a first relatively large-predetermined flow rate of fluid at a low vehicle speed and a second predetermined flow rate of fluid at a high vehicle speed, that is less than the first one.

As illustrated in FIG. 1, the flow control apparatus is built in a pump housing together with a pump body 15 to form the rotary-vane pump 11 as one unit. The rotary-vane pump 11 includes a pump shaft 12 drivingly connected with the power source such as engine, a cover 13 and a casing 14 cooperating with the cover 13 to define a cavity in which the pump body 15 disposed within the cavity. A suction passage 16 is formed in the casing 14 and fluidly connected with the suction side of the pump body 15. The suction passage 16 is also fluidly connected with a reservoir. A discharge bore 17 is formed in the casing 14 and constitutes a part of a discharge passage permitting fluid discharged from the discharge side of the pump body 15 to pass therethrough and be fed to the hydraulic actuator. Reference numerals 18 and 19 denote a metallic bearing and an oil seal that are disposed within the casing 14, respectively.

The pump body 15 includes a cylindrical rotor 20 operatively connected with the pump shaft 12, a plurality of vanes 21 radially reciprocally moveably mounted to an outer periphery of the rotor 20, a cam ring 22 having an internal circumferential cam surface opposed to the outer periphery of the rotor 20, and two end plates 23 disposed on opposite axial ends of each of the rotor 20 and the cam ring 22. In FIG. 1, one of the two end plates 23 is illustrated. The vanes 21, the outer periphery of the rotor 20, the internal circumferential cam surface of the cam ring 22 and the end plates 23 cooperate to define pumping chambers therebetween. The pumping chambers vary in volume as the rotor 20 rotates and the vanes 21 slide on the internal circumferential cam surface of the cam ring 22 that has a generally elliptic shape in section. The pump body 15 conducts the continuous pumping action by the volumetric change of the pumping chambers, supplying the fluid pressure. The structure of the pump body 15 is generally known and, for example, described in German Patent Application First Publication No. DE4433598A1 published on Mar. 28, 1996, which is incorporated by reference.

The end plate 23 has outlet ports 24*a* and 24*b* and inlet ports, not shown, which are communicated with the volumetrically decreasing pumping chamber and the volumetrically increasing pumping chamber of the pump body 15, respectively. The inlet ports are also fluidly connected with the suction passage 16 to communicate the suction passage 16 with the volumetrically increasing pumping chamber of the pump body 15. The outlet ports 24*a* and 24*b* are fluidly connected with the discharge bore 17 open to an end face of the casing 14 which mates with one end face of the end plate 23. The discharge bore 17 is communicated with the volumetrically decreasing pumping chamber of the pump body 15 via a pressure chamber 25 of the pump body 15 and a variable flow control valve 26, as explained in detail later. The pressure chamber 25 is defined by the cover 13 and the pump body 15 and has a generally annular shape. The outlet port 24*a* extends radially outward to be open into the pressure chamber 25. The outlet port 24*b* axially extends to be open to the one end face of the end plate 23 and then extends substantially perpendicularly to be open into the pressure chamber 25. The outlet port 24*b* thus is formed into a bending passage shape.

The discharge bore 17 is fluidly connected with the pressure chamber 25 via a communication passage 29 that is formed in the casing 14 to be open to the end face of the casing 14. The communication passage 29 has an axial passage portion extending along the axis of the pump shaft 12 and a radial passage portion substantially perpendicular to the axial passage portion. The discharge bore 17 and the communication passage 29 constitute the discharge passage through that the fluid discharged from the pump body 15 is delivered to the actuators.

The variable flow control valve 26 is disposed within the discharge passage. The variable flow control valve 26 is operative to vary a flow of fluid passing through the discharge passage. The variable flow control valve 26 includes a spool bore 27 communicating with the discharge side of the pump body 15, a spool 28 moveable in the spool bore 27 between positions where different opening areas of the discharge passage are defined, and a spring 30 biasing the spool 28 in such one direction as to increase the opening area of the discharge passage. The spool 28 is displaceable between the positions by a biasing force of the spring 30 and a force variably acting on the spool 28 in response to the flow rate of fluid discharged from the pump body 15. The spool 28 has one surface facing the force, i.e., dynamic pressure, of fluid discharged from the pump body 15 via the outlet port 24*b*, and an opposite surface facing the biasing force of the spring unit 30. The spring 30 is in the form of a spring unit including a first spring 38 and a second spring 39 and a displacement stop 40 interconnecting the first and second springs 38 and 39. The first and second springs 38 and 39 are arranged in series through the displacement stop 40. The first spring 38 has a first rigidity and a second spring 39 has a second rigidity greater than the first rigidity. The displacement stop 40 restricts the compression of the first spring 38 in a direction opposite to the one direction. Namely, this direction is such a direction that the spool 28 is forced to move to reduce the opening area of the discharge passage.

Specifically, the spool bore 27 is formed in the casing 14 and extends in the axial direction of the pump shaft 12 to be open to the end face of the casing 14. The spool bore 27 intersects the radial passage portion of the communication passage 29. The variable flow control valve 26 has valve-inlet and valve-outlet ports which communicate with the radial passage portion of the communication passage 29 as to allow the fluid to flow into the spool bore 27 and pass therethrough to enter the discharge bore 17. Thus, the spool bore 27 extends in a transverse direction relative to the flow of fluid passing through the discharge passage. The spool bore 27 is opposed to the outlet port 24*b* of the end plate 23 to communicate with the volumetrically decreasing pumping chamber of the pump body 15. The spool 28 is formed into a hollow cylindrical shape having a disk-like bottom wall 28A and a circumferential side wall 28B which are joined together to define a spring mount bore accommodating the spring unit 30. The bottom wall 28A has an outer surface facing the dynamic pressure of fluid in the outlet port 24*b* and an inner surface facing the biasing force of the spring unit 30. The circumferential side wall 28B is opposed to the opening area of the discharge passage. The displacement stop 40 is fitted to the spring mount bore of the spool 28. The displacement stop 40 has a rod portion 42 extending along the axis of the pump shaft 12 toward a bottom of the spool bore 27, and a flange portion 41 extending radially outward from the rod portion 42. The rod portion 42 has such a length as to contact the bottom of the spool bore 27 at an axial end thereof when the first spring 38 is displaced to a compressed state by a predetermined distance due to the movement of the spool 28 against the first spring 38. The flange portion 41 is interposed between the first and second springs 38 and 39. The spool bore 27, the circumferential side wall 28B of the spool 28, and the displacement stop 40 cooperate to define a first spring chamber within the spring mount bore that accommodates the first spring 38. In this embodiment, the first spring 38 is a coil spring, through which the rod portion 42 of the displacement stop 40 extends toward the bottom of the spool bore 27. The first spring 38 has one end retained by the bottom of spool bore 27 and an opposite end retained by the flange portion 41 of the displacement stop 40. The bottom wall 28A and circumferential side wall 28B of the spool 28 and the flange portion 41 of the displacement stop 40 cooperate to define a second spring chamber within the spring mount bore that accommodates the second spring 39. The second spring 39 has one end retained by the bottom wall 28A of the spool 28 and an opposite end retained by the flange portion 41 of the displacement stop 40. A coned disk spring is used as the second spring 39 in this embodiment.

The spool 28 has its normal position shown in FIG. 1, in which the spool 28 is urged against the end plate 23 by the first spring 38 to allow a maximum opening area of the discharge passage. The spool 28 is moveable by the fluid pressure within the pressure chamber 25 against the biasing forces of the first and second springs 38 and 39, from the normal position to positions in which the spool 28 is spaced leftward as viewed in FIG. 1, from the end plate 23 to allow reduced opening areas of the discharge passage that are smaller than the maximum opening area thereof.

Figure 3:
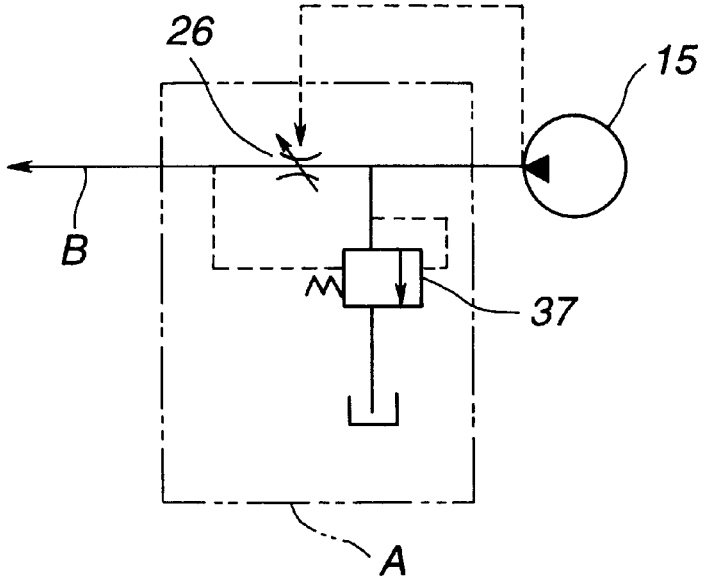
FIG. 3 is a schematic diagram of the first embodiment.

As shown in FIG. 3, the discharge passage B has a portion disposed within a flow control circuit A cooperative with the discharge passage B to permit a predetermined flow of the fluid discharged from the pump body 15. The flow control circuit A includes a drain valve 37 actuatable to drain the fluid in response to a difference between pressures upstream and downstream of the variable flow control valve 26. The drain valve 37 is fluidly connected with the reservoir.

Referring back to FIG. 1, the drain valve 37 includes a spool bore 31 formed in the casing 14 in communication with the pressure chamber 25, a spool 32 slidably disposed in the spool bore 31, and a return spring 33 biasing the spool 32 toward the pressure chamber 25. The spool bore 31 extends substantially parallel to the axis of the pump shaft 12. A drain passage 34 is open at one end thereof to the spool bore 31 near an open end of the spool bore 31 that is opposed to the pressure chamber 25. The drain passage 34 communicates with the suction passage 16. An induction passage 35 is open at one end thereof to the spool bore 31 near a bottom of the spool bore 31. The induction passage 35 communicates with the discharge bore 17. The spool 32 divides the spool bore 31 into a spool pressure chamber disposed on the open end side of the spool bore 31, and a spool back pressure chamber 36 disposed on the bottom side of the spool bore 31. The spool pressure chamber is in communication with the pressure chamber 25 of the pump body 15 and the spool back pressure chamber 36 is in communication with the discharge bore 17 via the induction passage 35. The spool 32 is reciprocally moveable in the spool bore 31 to open and close the open end of the drain passage 34 in response to a difference between pressures in the pressure chamber 25 and the discharge bore 17. Namely, the spool 32 reciprocates in the spool bore 31 to control the fluid communication of the drain passage 34 with the pressure chamber 25 in response to the difference between pressures upstream and downstream of the variable flow control valve 26. A flow of fluid discharged from the pressure chamber 25 is controlled by the reciprocal movement of the spool 32. The spool 32 has a normal position shown in FIG. 1, in which the spool 32 is urged by the spring 33 to close the open end of the drain passage 34 to restrain the fluid communication between the pressure chamber 25 and the drain passage 34. The spool 32 is moveable by the fluid pressure in the pressure chamber 25 from the normal position to a position in which the spool 32 is located leftward as viewed in FIG. 1, against the biasing force of the spring 33 to open the open end of the drain passage 34 to allow the fluid communication between the pressure chamber 25 and the drain passage 34 via the spool pressure chamber.

A relief valve, not shown, of a known type is disposed within the discharge bore 17. The relief valve is adapted to prevent a fluid pressure in the discharge bore 17 from extremely rising up, the structure of that is described in, for instance, U.S. Pat. No. 5,098,259.

An operation of the variable flow control apparatus of the invention will be explained hereinafter by referring to FIGS. 1 and 2.

When the pump shaft 12 is in its non-rotating state and the pumping action of the pump body 15 is stopped, the spool 28 of the variable flow control valve 26 and the spool 32 of the drain valve 37 are placed in the respective normal positions where the spools 28 and 32 are contacted with the end plate 23 as shown in FIG. 1. The spool 28 allows the maximum opening area of the discharge passage while the spool 32 prevents the drain passage 34 from being communicated with the pressure chamber 25 of the pump body 15.

When the pump shaft 12 is driven to start its rotation, the pump body 15 actuates to discharge fluid from the volumetrically increasing pumping chamber into the discharge bore 17 via the outlet ports 24*a* and 24*b*, the pressure chamber 25, the communication passage 29, and the variable flow control valve 26. In this condition, until the rotational speed of the pump body 15 reaches a first set value a shown in FIG. 2, both of the static pressure of fluid within the pressure chamber 25 and the dynamic pressure of fluid within the outlet port 24*b* are low. The spool 28 of the variable flow control valve 26 and the spool 32 of the drain valve 37 are still placed in the respective normal positions, so that a flow rate of fluid discharged from the discharge bore 17 increases as the rotational speed of the pump body 15 rises.

When the rotational speed of the pump rises up to the first set value a and the difference between pressures upstream and downstream of the variable flow control valve 26 becomes greater than a certain value, the spool 32 of the drain valve 37 is moved toward the bottom of the spool bore 31 to allow an excessive amount of the fluid in the pressure chamber 25 to flow into the drain passage 34. The flow rate of fluid discharged from the discharge bore 17 is kept at a first predetermined value q1. This flow control continues until the rotational speed of the pump body 15 reaches a second set value b higher than the first set value a.

When the rotational speed of the pump body 15 exceeds the second set value b and the dynamic pressure of fluid discharged from the outlet port 24*b* becomes not less than a certain level, the spool 28 of the variable flow control valve 26 is forced by the dynamic pressure to move toward the bottom of the spool bore 27 against the biasing force of the first spring 38. The first spring 38 is compressed as the spool 28 is retracted into the spool bore 27. The opening area of the valve-outlet port connected to the discharge bore 17 is reduced from the maximum depending on the movement of the spool 28. The flow rate of fluid discharged from the discharge bore 17 becomes lower than the first predetermined value q1. Until the rotational speed of the pump body 15 rises up to a third set value c higher than the second set value b, the flow rate of fluid discharged from the discharge bore 17 continues to decrease.

When the rotational speed of the pump body 15 reaches the third set value c, the tip end of the rod portion 42 of the displacement stop 40 of the variable flow control valve 26 contacts the bottom of the spool bore 27 so that the first spring 38 is prevented from being further compressed. The flow rate of fluid discharged from the discharge bore 17 reaches a second predetermined value q2 lower than the first predetermined value q1. Subsequently, when the rotational speed of the pump body 15 becomes higher than the third set value c, load is caused by the dynamic pressure of fluid discharged from the outlet port 24*b*. Under this condition, assuming that the opening area of the valve-outlet is no longer reduced and besides, for instance, the spool 32 of the drain valve 37 is delayed in response to the raise of the pump rotational speed, the flow rate of fluid discharged from the discharge bore 17 begins to gradually increase to be higher than the second predetermined value q2 as indicated by the broken line P in FIG. 2. However, with the arrangement of the apparatus of the first embodiment, the second spring 39 between the spool 28 and the displacement stop 40 is brought into being compressed by the load applied thereto via the spool 28. The spool 28 is further moved toward the bottom of the spool bore 27 against the biasing force of the second spring 39, so that the opening area of the valve-outlet port connected with the discharge bore 17 is further reduced. Thus, since the opening area of the valve-outlet port is further reduced by the spool 28 further moving along with the compression of the second spring 39, the increment of the flow rate of fluid discharged from the discharge bore 17 is eliminated. As a result, after the pump rotational speed becomes higher than the third set value c, the flow rate of fluid discharged from the discharge bore 17 is kept constant at substantially the second predetermined value q2 as indicated by the solid line R in FIG. 2.

Figure 2:
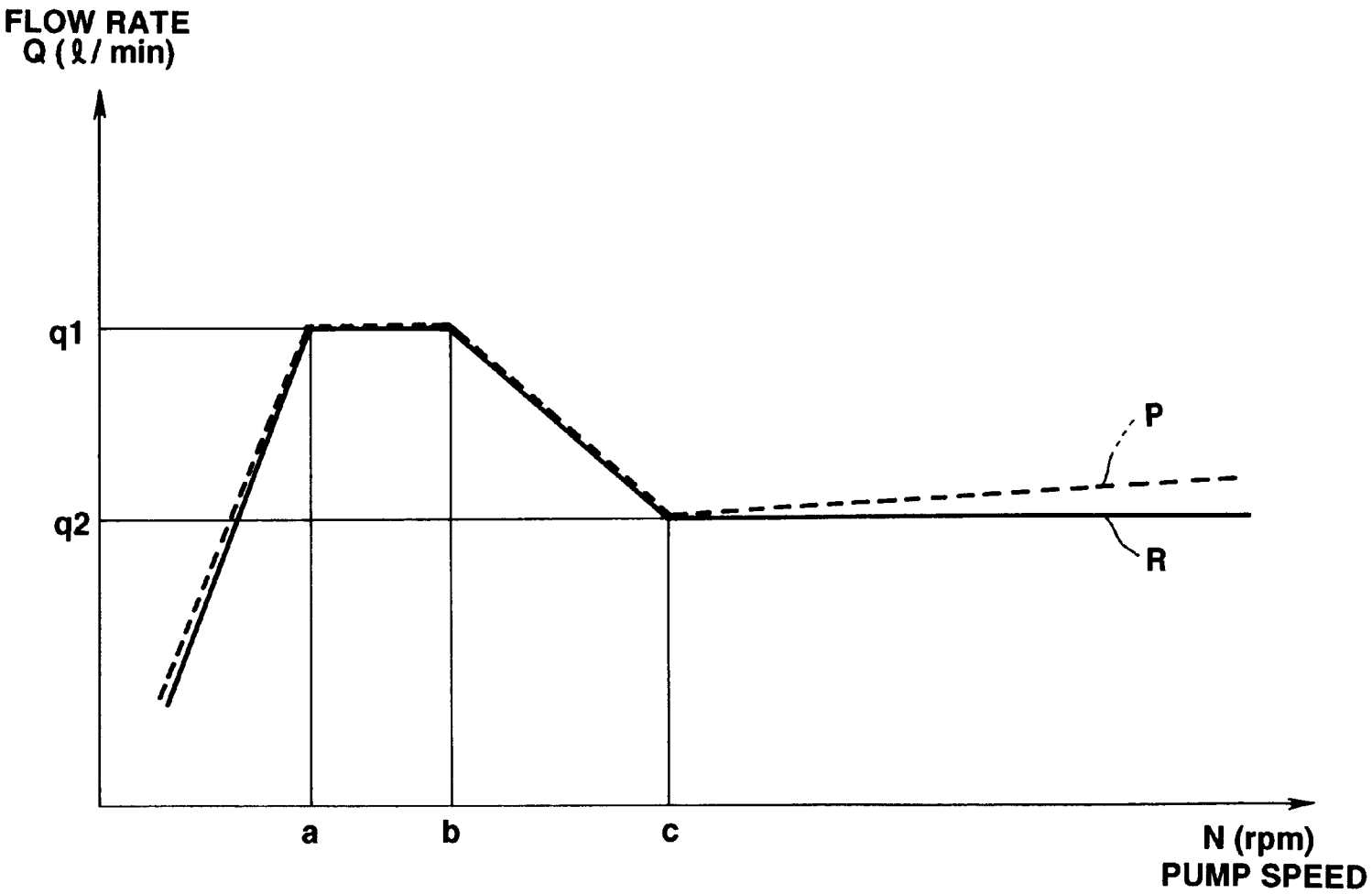
FIG. 2 is a graph showing a relationship between the discharge flow and the rotational speed of the pump.

As seen from the above description, the rotary-vane pump 11 with the flow control apparatus can provide the first predetermined flow rate q1 at the low rotational speed a to b and the second predetermined flow rate q2 at the high rotational speed c as shown in FIG. 2. Accordingly, the rotary-vane pump 11 can supply actuators with the fluid pressure required for desirably operating hydraulic equipment connected with the actuators at both the low rotational speed and the high rotational speed. This serves for enhancing the operating performance of the actuators and the hydraulic equipment. The positive-displacement pump may be a plunger pump, a gear pump, or the like.

Further, it will be appreciated from the above explanation that, since the spring unit 30 of the variable flow control valve 26 has the serial arrangement of the first spring 38 and the second spring 39 greater in rigidity than the first spring 38, the compression of the first spring 38 is caused prior to the compression of the second spring 39, upon the rotational speed of the pump body 15 increasing. By the compression of the first spring 38, the opening area of the discharge passage is reduced to lower the flow rate of fluid passing through the discharge passage to the second predetermined value q2. Owing to the compression of the second spring 39 subsequent to the compression of the first spring 38, the opening area of the discharge passage is further reduced, causing gradual and slow decrease of the flow rate of fluid passing through the discharge passage. The decrease of the flow rate that is caused by the compression of the second spring 39 can eliminate the increment of the flow rate that occurs, for instance, with the delayed response of the drain valve 37, in the pump operation at the high rotational speed. As a result, the flow rate of fluid discharged from the pump body 15 at the high rotational speed can be kept constant at substantially the second predetermined value q2 while the rotational speed of the pump body 15 further increases to exceed the set value c. Therefore, the variable flow control apparatus of the present invention can exhibit the desired characteristic of the flow rate of fluid discharged from the pump body 15 in the pump operation at each of the low rotational speed and the high rotational speed.

Furthermore, with the arrangement of the displacement stop 40 restraining the compression of the first spring 38, the second spring 39 having a greater rigidity than the first spring 38 can be compressed after the compression of the first spring 38 is completely restricted by the displacement stop 40. Accordingly, the compression of the second spring 39 is assured to occur at the high rotational speed, i.e., the rotational speed higher than c as shown in FIG. 2. This allows the action of the spool 28 to be readily controlled in the pump operation at the high rotational speed, serving for more accurate control of the flow rate of fluid discharged from the pump body 15 at the high rotational speed. To this end, it will be possible to easily obtain the desirable characteristic of the flow rate of fluid discharged from the pump body 15 at the high rotational speed.

In addition, in this embodiment, the use of the coned disk spring as the second spring 39 contributes to volumetric reduction of the second spring chamber within the spool 28. This results in reduction of dimension of the spring unit 30 and the variable flow control valve 26 as a whole.

The second spring 39 is not limited to the coned disk spring as described in the first embodiment but it can be in the form of a coil spring. In the case of using the coil spring as the second spring 39, the characteristic of the compression displacement relative to load is linearly indicated, so that the desirable characteristic of the flow rate of fluid discharged from the pump body 15 at the high rotational speed will be readily obtained. Further, since the coil spring is easily produced, the use of the coil spring serves for saving the manufacturing cost.

Further, the above-described simple structure of the spring unit 30 of the variable flow control valve 26 contributes to easy achievement of the desirable characteristic of the flow rate of fluid discharged from the pump body 15 at each of the low rotational speed and the high rotational speed. The simple structure also serves for reducing the manufacturing cost of the flow control apparatus.

Furthermore, in the first embodiment, the dynamic pressure in the outlet port 24*b* is utilized as the force variably acting on the spool 28 in response to the flow rate of fluid discharged from the pump body 15. However, in a case where an orifice adapted to permit the entire flow of fluid discharged from the pump body 15 to pass therethrough is disposed within the discharge passage, a difference between pressures upstream and downstream of the orifice may be utilized for actuating the spool 28. In this case, since the difference between pressures upstream and downstream of the orifice varies in response to the flow rate of fluid from the pump body 15, the spool 28 can be actuated when the rotational speed of the pump body 15 reaches the set value.

Figure 4:
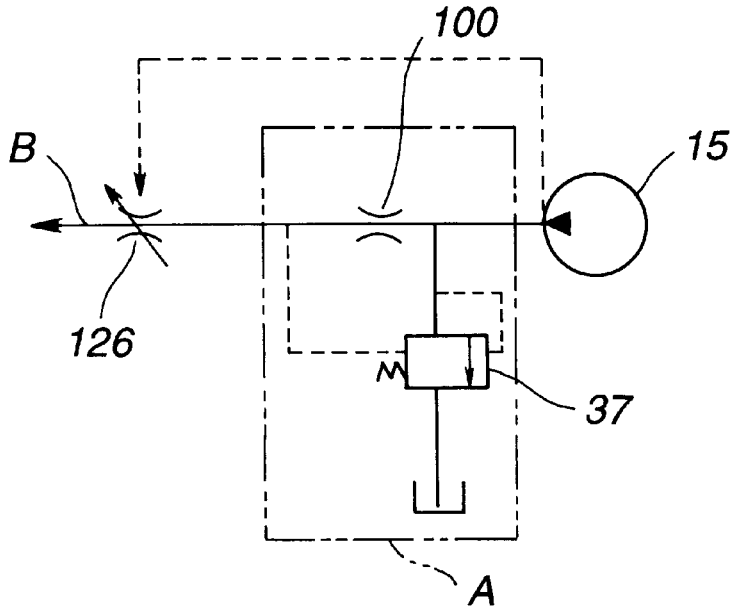
FIG. 4 is a schematic diagram of a second embodiment of the apparatus according to the present invention.

Referring to FIG. 4, a second preferred embodiment of the flow control apparatus will be explained hereinafter.

In FIG. 4, a fixed orifice 100 is disposed within a portion of the discharge passage B which cooperates with the flow control circuit A. The variable flow control valve 126 is disposed within discharge passage B downstream of the fixed orifice 100 and the flow control circuit A. The variable flow control valve 126 has the same structure as the variable flow control valve 26 explained in the first embodiment.

What is claimed is:

1. An apparatus for variably controlling a flow rate of fluid discharged from a positive-displacement pump, comprising:

a discharge passage communicating with the pump;

a variable flow control valve operative to vary a flow of fluid passing through the discharge passage, said variable flow control valve being disposed within the discharge passage; and a flow control circuit cooperative with the discharge passage to permit a predetermined flow of the fluid, said flow control circuit including a drain valve actuatable in response to a difference between pressures upstream and downstream of the variable flow control valve;

said variable flow control valve including a spool bore communicating with the discharge side of the pump, a spool moveably disposed in the spool bore and having positions where different opening areas of the discharge passage are defined, and a spring biasing the spool in such one direction as to increase the opening area of the discharge passage, said spool being displaceable between the positions by a biasing force of the spring and a force variably acting on the spool in response to the flow rate of fluid discharged from the pump;

wherein said spring includes a first spring and a second spring arranged in series, and wherein the variable flow control valve includes a displacement stop restricting displacement of the first spring in a compression direction opposite to the one direction, said displacement stop interconnecting the first and second springs.

2. An apparatus as claimed in claim 1, wherein the first spring has a rigidity and the second spring has a second rigidity greater than the rigidity of the first spring.

3. An apparatus as claimed in claim 1, wherein the discharge passage has a portion disposed within the flow control circuit, said variable flow control valve being disposed within the portion of the discharge passage.

4. An apparatus as claimed in claim 1, wherein the spool, the spool bore and the displacement stop cooperate to define a first spring chamber accommodating the first spring and the spool and the displacement stop cooperate to define a second spring chamber accommodating the second spring.

5. An apparatus as claimed in claim 4, wherein the spool is formed into a hollow cylindrical shape having a spring mount bore forming a part of each of the first and second spring chambers, said spool including a bottom wall defining opposed surfaces which face the biasing force of the spring and the variable acting force, and a circumferential side wall facing the opening area of the discharge passage.

6. An apparatus as claimed in claim 5, wherein the displacement stop includes a rod portion extending through the first spring and a flange portion extending radially outward from the rod portion and disposed between the first and second springs, said rod portion having such a length as to contact a bottom of the spool bore upon the first spring being displaced to a compressed state by a predetermined distance due to the movement of the spool against the first spring.

7. An apparatus as claimed in claim 1, wherein the spool bore extends in a transverse direction relative to the flow passing through the discharge passage.

8. An apparatus as claimed in claim 1, wherein the first spring includes a coil spring.

9. An apparatus as claimed in claim 1, wherein the second spring includes a coned disk spring.

10. An apparatus as claimed in claim 1, wherein the second spring includes a coil spring.

11. An apparatus for variably controlling a flow rate of fluid discharged from a positive-displacement pump, comprising:

a discharge passage communicating with the pump;

a fixed orifice disposed within the discharge passage;

a flow control circuit cooperative with the discharge passage to permit a predetermined flow of the fluid, said flow control circuit including a drain valve actuatable in response to a difference between pressures upstream and downstream of the fixed orifice; and a variable flow control valve operative to vary a flow of fluid passing through the discharge passage, said variable flow control valve being disposed within the discharge passage downstream of the fixed orifice, said variable flow control valve including a spool bore communicating with the discharge side of the pump, a spool moveably disposed in the spool bore and having positions where different opening areas of the discharge passage are defined, and a spring biasing the spool in such one direction as to increase the opening area of the discharge passage, said spool being displaceable between the positions by a biasing force of the spring and a force variably acting on the spool in response to the flow rate of fluid discharged from the pump;

wherein said spring includes a first spring and a second spring arranged in series, and wherein the variable flow control valve includes a displacement stop restricting displacement of the first spring in a compression direction opposite to the one direction, said displacement stop interconnecting the first and second springs.

12. An apparatus as claimed in claim 11, wherein the first spring has a rigidity and said second spring has a second rigidity greater than the rigidity of the first spring.

13. An apparatus as claimed in claim 11, wherein the discharge passage has a portion disposed within the flow control circuit, said fixed orifice being disposed within the portion of the discharge passage.

14. An apparatus as claimed in claim 11, wherein the spool, the spool bore and the displacement stop cooperate to define a first spring chamber accommodating the first spring and the spool and the displacement stop cooperate to define a second spring chamber accommodating the second spring.

15. An apparatus as claimed in claim 14, wherein the spool is formed into a hollow cylindrical shape having a spring mount bore forming a part of each of the first and second spring chambers, said spool including a bottom wall defining opposed surfaces which face the biasing force of the spring and the variable acting force, and a circumferential side wall facing the opening area of the discharge passage.

16. An apparatus as claimed in claim 15, wherein the displacement stop includes a rod portion extending through the first spring and a flange portion extending radially outward from the rod portion and disposed between the first and second springs, said rod portion being contacted with a bottom of the spool bore upon the spool moving in the opposite direction by a predetermined distance.

17. An apparatus as claimed in claim 11, wherein the spool bore extends in a transverse direction relative to the flow passing through the discharge passage.

18. An apparatus as claimed in claim 11, wherein the first spring includes a coil spring.

19. An apparatus as claimed in claim 11, wherein the second spring includes a coned disk spring.

20. An apparatus as claimed in claim 11, wherein the second spring includes a coil spring.

* * * * *